US007441675B2

(12) United States Patent
McGinley et al.

(10) Patent No.: US 7,441,675 B2
(45) Date of Patent: Oct. 28, 2008

(54) FLEXIBLE PANEL PITCHER

(76) Inventors: Michael L. McGinley, 4013 W. 69th St., Prairie Village, KS (US) 66208; Brian Lau, 3508 Linneman, Glenview, IL (US) 60025

( * ) Notice: Subject to any disclaimer, the term of this patent is extended or adjusted under 35 U.S.C. 154(b) by 268 days.

(21) Appl. No.: 10/770,325

(22) Filed: Feb. 2, 2004

(65) Prior Publication Data

US 2004/0155070 A1 Aug. 12, 2004

Related U.S. Application Data

(63) Continuation-in-part of application No. 10/357,651, filed on Feb. 4, 2003, now abandoned.

(51) Int. Cl.
*B65D 37/00* (2006.01)
*B65D 35/22* (2006.01)
*B65D 6/28* (2006.01)

(52) U.S. Cl. ..... 222/129; 222/210; 222/574; 220/609; 220/904

(58) Field of Classification Search ..... 222/206–215, 222/566–574, 129, 94; 220/608, 609, 904, 220/530, 9.4, 23.88, 666, 669; 215/382, 215/400; 229/400
See application file for complete search history.

(56) References Cited

U.S. PATENT DOCUMENTS

| | | | | | |
|---|---|---|---|---|---|
| 33,737 | A | * | 11/1861 | Fitts | 119/65 |
| 2,333,014 | A | * | 10/1943 | Kennedy | 220/645 |
| 2,872,081 | A | * | 2/1959 | Randall | 222/183 |
| 3,729,553 | A | * | 4/1973 | Gold et al. | 424/44 |
| 4,609,113 | A | * | 9/1986 | Seki | 215/382 |
| 4,756,439 | A | * | 7/1988 | Perock | 68/233 |
| 4,886,206 | A | * | 12/1989 | Martinez | 229/123.1 |
| 4,955,503 | A | * | 9/1990 | Propes | 220/526 |
| RE35,933 | E | * | 10/1998 | Scholl | 220/695 |
| 5,960,987 | A | * | 10/1999 | Solland et al. | 220/834 |

* cited by examiner

*Primary Examiner*—Kevin P. Shaver
*Assistant Examiner*—Melvin A Cartagena
(74) *Attorney, Agent, or Firm*—Shughart Thomson & Kilroy PC

(57) ABSTRACT

A container or pitcher is provided having a flexible side wall portion and rim portion of the container which can conform to the shape of an object to which the pitcher is applied to thereby direct fluid flow from the pitcher over a broader area and to prevent fluid from flowing from the pitcher and underneath the rim of the pitcher and onto portions of the object to which it is not desirable to apply the fluid.

12 Claims, 3 Drawing Sheets

FLEXIBLE PANEL PITCHER

This is a continuation-in-part of application Ser. No. 10/357,651 filed Feb. 4, 2003 now abandoned.

FIELD OF THE INVENTION

The present invention relates to containers, specifically containers used to hold fluids and, in particular, a container having a flexible side wall portion and rim portion which is capable of conforming to the shape of an object to which the pitcher is applied to more particularly direct the flow of fluid from the pitcher and to prevent the flow of fluid from the pitcher and onto areas to which application of the fluid is not intended .

BACKGROUND OF THE INVENTION

When using pitchers to pour fluids, it is frequently desired to pour a stream of the fluid into a specific location, such as a glass or other container. Alternatively, it may be useful to use a container or a pitcher that does not provide an actual spout, but rather, simply has a rim when it is desired to pour a greater amount of fluid or broader stream of fluid onto an object such as when rinsing a floor or an automobile. However, both of these types of containers and pouring operations present specific drawbacks to particular applications. For example, when using a pitcher having a spout, the fluid that is poured from the pitcher can only be applied to a particular area, specifically, that area determined by the stream of fluid as it exits the spout. While this is useful for pouring water into a glass, another container or a specific area, it is not useful for applying the fluid to a larger area. Also, the use of a spout while narrowing the stream of water, nevertheless, provides a narrow column-like stream of water which, when it contacts the object or container toward which it is directed, will flow in all directions.

The other case of pouring a fluid from a container—that is the case of a bucket or other broad-rimmed container—also presents limitations with respect to the pouring of a fluid. In the case of a bucket or a pitcher having no spout, the water will flow from the pitcher over the rim or edge of the pitcher and create a broad stream of fluid flowing from the pitcher which will be related to the angle of the longitudinal axis of the pitcher as it moves from vertical to horizontal. To state the obvious, when the longitudinal axis of the pitcher (that is the axis passing through the bottom of the pitcher and the top of the pitcher) is parallel to vertical, no fluid will flow from the pitcher. As the longitudinal axis is tilted increasingly toward a horizontal plane, more and more fluid will flow over the rim of the pitcher, and the stream flowing from the pitcher will be increasingly wide. While such a spoutless pitcher, such as a bucket, provides a wide stream of fluid which is useful in, for example, rinsing an area, there is still no control over the distribution of that stream over the object on which it is poured. Specifically, if a stream of water is poured from a bucket, when the stream of water contacts the object on which it is poured, the water will flow in all directions and will not be limited to a single direction of flow. Even if the rim of the pitcher is pressed directly against -the object onto which the fluid is to flow, the fluid will flow back toward the pitcher and underneath the pitcher and onto portions of the object which are near the side wall of the pitcher.

In the specific case of rinsing shampoo and other hair treatments from the head of a child, this "backflow" from a pitcher can provide compelling support for the Victorian premise that children should be seen and not heard. Specifically, the backflow of rinse water from a pitcher that is used to dip bath water and to lift it to rinse the head of a child can cause shampoo and other hair and scalp treatments to flow down the forehead of the child and into the eyes and face of the child. This will cause the child to notify the parent of the situation through loud screams, tears and arm movements. The prospect of rinsing soap suds into the eyes and mouth and nose of a child is not pleasant for either the parent or the child and can lead to difficulties as bath time approaches. Usually it is the case that the best of attempts to try to limit this problem are unsuccessful. Asking the child to close his or her eyes tightly while the rinsing is proceeding will be only partially successful. The child, for one reason or another, may open their eyes during the rinsing procedure whereupon the soapy water contacts and stings their eyes. Alternatively, the child may improperly time the closing of their eyes with the application of the rinse water and receive a stinging realization of their incapacity to coordinate their eyelid movements. Even should the parent attempt to assist the situation by placing a hand across the forehead of the child, some soapy water will inevitably trickle down the forehead of the child and into the child's eyes, mouth or nose.

Therefore, it would be a great benefit if a rinse container or pitcher could be provided which would prevent the flow of rinse water from a rinse pitcher or container and back underneath the rim of the container thereby providing specific, directional application of rinse water to an object such as a child's head.

Yet another benefit would be obtained from a pitcher or rinse container which could provide a broad flow of rinse water to an object to more efficiently rinse the object and while providing means for directing the flow of the rinse water from the pitcher and onto the object while preventing the backflow of rinse water onto areas of the object to which rinse water is not intended to be applied.

It would still be a further benefit if such a pitcher or rinsing container could conform to the shape of the object to which the rinse water in the pitcher was to be applied thereby restricting the portions of the object which will receive rinse water from those portions of the object which will not receive rinse water. These objects and benefits and more are provided by the present invention which is more completely described hereinafter.

SUMMARY OF THE INVENTION

The present invention solves the preceding problems and improves the state of the art by providing a pitcher for holding solutions such as rinse water or shampoo or other liquids to allow application of those liquids to a localized portion of the body such as the head. The present invention provides a flexible panel and/or flexible rim portion of the container which conforms to the shape of the an object, such as the head of an individual, to allow application of the fluid to the body and to prevent misapplication of the fluid by preventing fluid from flowing underneath the rim and onto body parts to which it is not desired to apply the fluid.

In one embodiment, the invention provides a flexible panel which can conform to the shape of the child's head or other object to effectively seal off passage of fluids back under the flexible rim thereby allowing application of the fluid, such as rinse water, to the child's hair while preventing the flow of rinse water and a rinse water-shampoo mixture down into the child's face and eyes.

In another embodiment a divider panel is provided within the container to provide a second source of fluid flow onto the object to which the container is applied to provide a source of flow that is not partially deflected from the object by the deflection of the flexible panel as it conforms to the shape of the child's head or other object to which the flexible panel is applied.

These other objects are intended to be illustrative of the invention and are not meant in a limiting sense. Many possible embodiments of the invention may be made and will be evident upon a study of the following specification and accompanying drawings. Various features and subcombinations of invention may be employed without reference to other features and subcombinations. Other objects and advantages of this invention will become apparent from the following description and drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF THE PREFERRED EMBODIMENT

Figure 1:
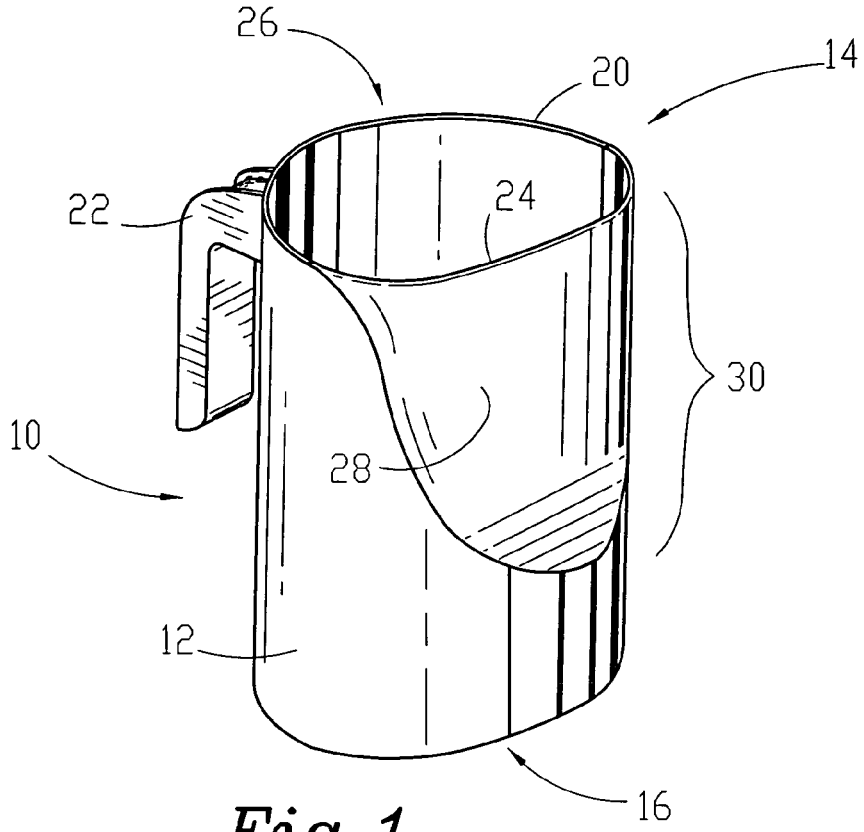
FIG. 1 is a top and side perspective view of the pitcher of the present invention showing the flexible panel which comprises a portion of the side wall of the container and the top edge of the side wall of the container.
Figure 2:
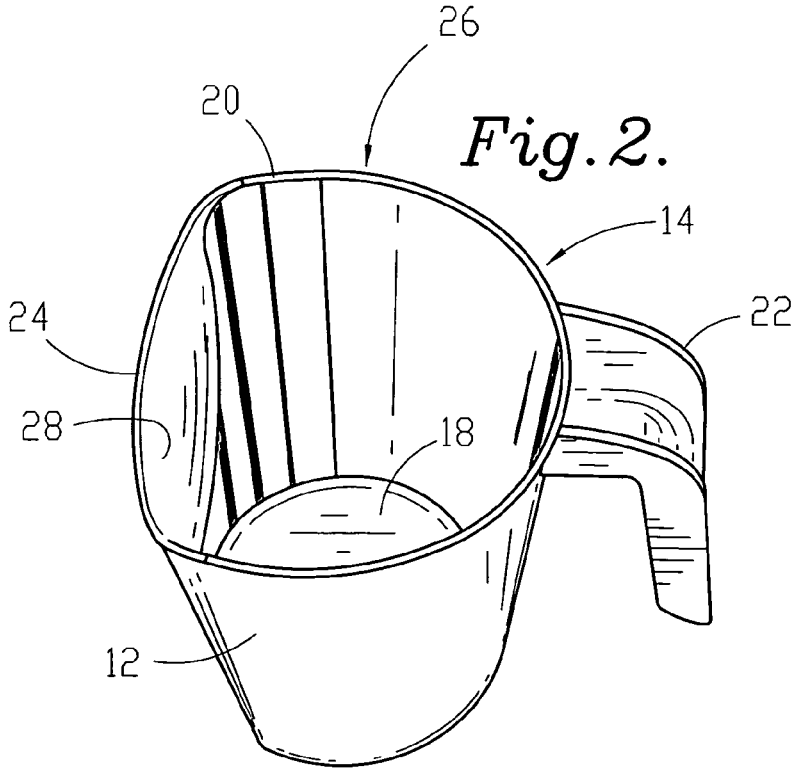
FIG. 2 is a top and interior perspective view of the embodiment of FIG. 1 and showing the flexible wall opposite the handle.
Figure 3:
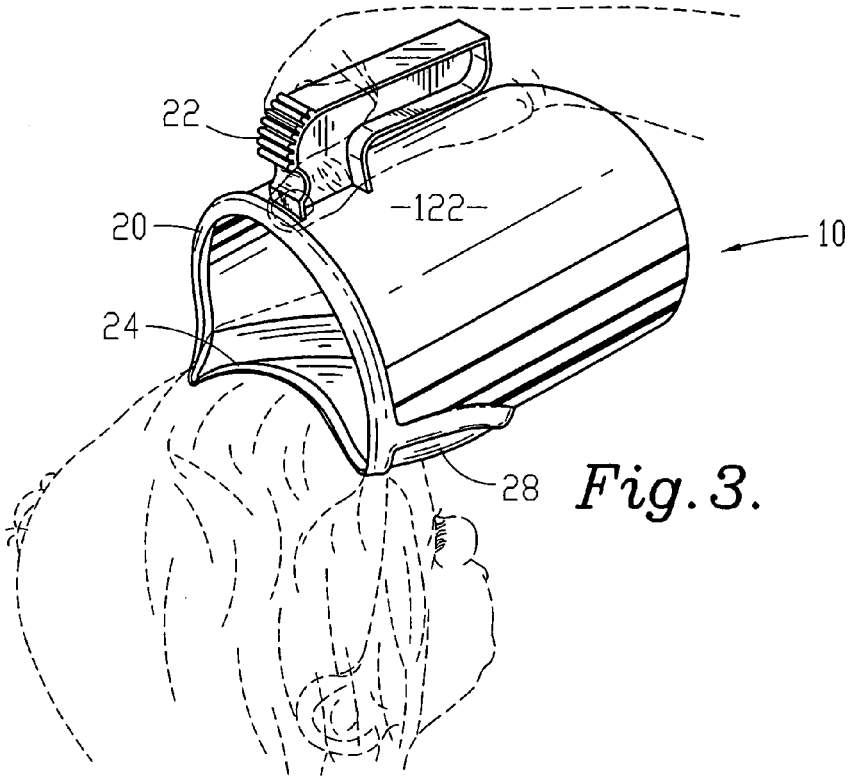
FIG. 3 shows the application of an embodiment of the invention to the head of a child to allow water to flow over the child's hair and back of the head while the flexible panel and flexible rim conform to the shape of the child's head and prevents water from flowing down the front of the child's head and into the child's eyes and face.

Referring now to FIG. 1, an embodiment of the inventive. container 10 is shown which is comprised of generally continuous side wall 12 which can be of any convenient shape, spanning shapes from square to circular to polygonal. Continuous side wall 12 terminates at either end in upper side wall end 14, and lower side wall end. Continuous side wall 12 can be formed of rubber or plastic or metal or wood or any material which will serve to hold a fluid within continuous side wall 12. Connected to a lower side wall end 16 is bottom or bottom panel 18 (FIG. 2) which serves to close lower side wall end 16 thereby allowing a fluid to be held within continuous side wall 12 and to bottom 18. It will be appreciated that, depending on the material used for the construction of side wall 12, bottom 18 could be constructed with the forming of side wall 12 thus forming a unitary construction of side wall 12 and bottom 18. As shown in FIG. 1, upper side wall end 14, depending on the material used for the construction of side wall 12, can form in and of itself a side wall rim 20, or an additional structure 20 (FIG. 3) can be attached to upper side wall end 14 to form a discreet side wall rim 20 (FIG. 3). Generally, side wall rim 20 will take the shape of upper side wall end 14, however, alternatively, decorative materials could be used to modify the shaping of side wall rim 20. For further convenience, and depending on the size of container 10, a handle 22 can be attached to side wall 12 to assist in the manipulation of container 10.

Side wall rim 20, in a preferred embodiment is comprised of side wall portion 24, which is a generally flat portion of side wall rim 20, and which may, therefore, differ, generally, in its shape as compared to the remainder of side wall rim 12 and side wall 20. For example, if side wall 12, in its construction, comprises a cylindrical container, then side wall rim 20 will be comprised of a generally circular side wall rim portion 26 and a generally flat side wall rim portion or side wall segment or rim segment 24. The utility and benefits of generally flat rim segment 24 will be described hereinafter. In a preferred embodiment, and in the vicinity of generally flat side wall rim portion 24, is flexible panel 28 which extends from side wall 12 toward generally flat side wall rim segment 24 to connect side wall 12 with rim segment 24. It will be appreciated by those skilled in the art that flexible panel 28 and rim segment 24 can be comprised of the to same materials or of different materials depending on the choice of construction. For example, flexible panel 28 may be thin flexible plastic, or a flexible rubber panel, or a waterproof canvas which is attached to side wall 12 and which extends upwardly toward upper side wall end 14 to connect with or form side wall rim segment 24. In such a construction, rim segment 24 could be of a different material which connects with flexible panel 28 or, for example, if a waterproof canvas were used, the canvas could be wrapped over a flexible cord or wire which would form rim segment 24. Therefore, it will be appreciated by those skilled in the art that one of the objects of a preferred embodiment of the present invention is to provide a flexible, shapable wall segment 30 of either side wall 12 or rim 20, or both rim 20 and side wall 12 which can conform to the shape of an object against which this flexible portion of container 10 is pressed.

Figure 4:
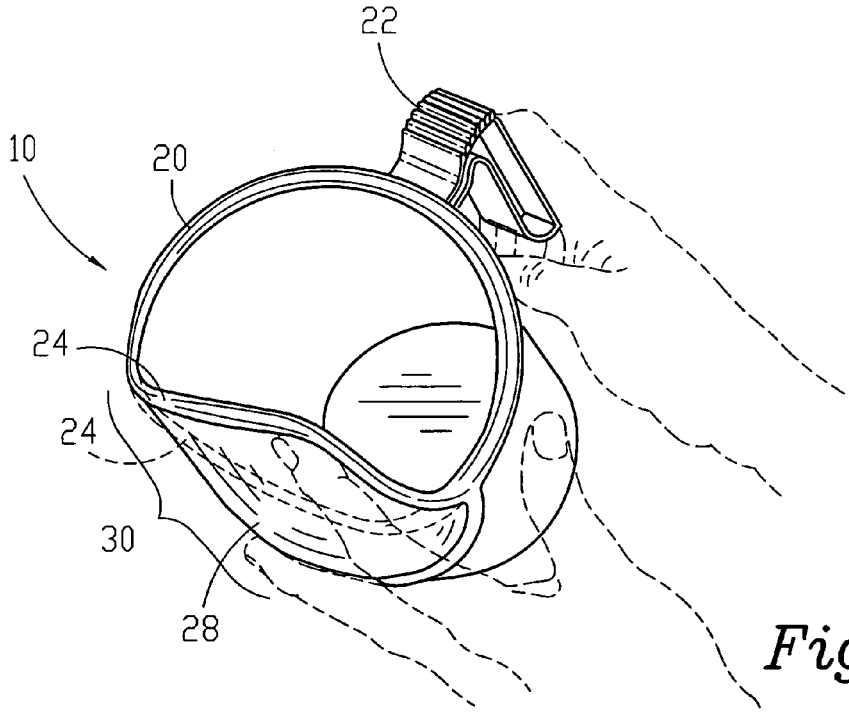
FIG. 4 shows the embodiment of FIG. 4 having a flexible panel and flexible rim and showing the panel and rim in a depressed position and showing the panel and rim in phantom lines in a relaxed or undepressed position.

Referring now to FIG. 4, the flexibility and construction of the novel flexible side wall portion and rim portion of container 10 will be further described. As is shown in FIG. 4, flexible panel 28 and rim segment 24 are deformable and can be pressed inwardly from the position shown in phantom lines and toward the interior of container 10. The benefits of this flexibility or malleability of flexible panel 28 and rim segment 24 are that the pouring portion of side wall rim 20, which is generally rim segment 24, can be formed, by compression of container 10 against the object on which fluid is to be poured, to the shape of the object which is to receive the fluid which is within container 10. Referring to both FIGS. 3 and 4, it is shown that flexible panel 28 and side wall rim 24 are capable of deformation inwardly. This feature of container 10 allows container 10 to be placed against an object, in this case, the forehead of a child (FIG. 3) to have flexible panel 28 and side wall rim 24 registerably mate with the head of the child to provide a wide pouring spout and wide volume of fluid therefor which can be evacuated from container 10 and poured onto the head of the child to rinse the hair of the child.

It will further be appreciated that it is the flexible character of panel 28 and side wall rim 24 which allow for the registerable mating of the flexible portion of container 10. Flexible wall portion 30 (FIGS. 1 and 4), made up of flexible panel 28 and side wall rim segment 24, conforms to the shape of the object or, in this case, the head of a child onto which fluid is to be poured from container 10, and thus, reducing or preventing the flow of fluid from container 10 and back under side wall rim 24 and panel 28. This benefit is particularly useful with respect to rinsing shampoo or other hair products from the hair of a child. The prevention of rinse fluid from draining underneath the side wall rim of a container to allow the rinse fluids and shampoo to run down the forehead of a child and into the eyes, nose and mouth prevent the unpleasantness of eyes stinging from the shampoo or other product being rinsed from the child's hair. The construction of flexible wall portion 30 can be continuous between panel 28 and rim segment 24 (FIGS. 1 and 2), or flex panel 28 and rim 24 can be separate constructions which join together FIGS. 3 and 4 to provide a flexible rim segment and side wall portion of container 10. For example, flex panel 28 could be formed from a flexible plastic, or a rubber panel or a waterproof cloth panel which connects with a rim segment 24 which is constructed of a flexible wire covered with sponge or covered with rubber or covered with a waterproof fabric. Alternatively, rim segment 24 could be a piece of rubber or piece of sponge which is placed across a rigid portion of side wall 12 which comprises any portion of side wall rim 20. In this construction, only the malleable or flexible rim segment 24 would conform to the shape of the object against which container 10 is pressed. In this embodiment only rim segment 24 is flexible and no flex panel is provided to connect between side wall 12 and rim segment 24. In such an embodiment, side wall 12 continues to join rim segment 24, and the flexible, malleable aspect is contained solely within side wall rim segment 24.

As has been described, the benefits of the present invention are achieved by a container having a flexible side wall segment and/or a flexible rim segment which allow close contact of the container with an object or the head of a child to prevent the wash back or flow of fluid from the container underneath the rim and side wall of the container, and which, thereby when rinsing the head of a child, prevents soapy water from getting into the eyes and face of the child. Further, the present invention, as previously described, allows the flexible portion of the container to mold to a shape against which it is pressed and to allow large volumes of fluid to be passed from the container onto the object by virtue of the generally flat rim segment which may contain a rubber cushion to ease contact with the head. It will further be appreciated that in an a alternative embodiment of this invention, the side wall could be provided with a concave portion which would generally conform to the curvature of a child's head and the side wall would be provided with a malleable rim segment on the concave side wall portion. The malleable rim segment portion would more closely register with the child's head than with the concave side wall segment thereby directing the flow of water over the child's head and preventing the flow of water back underneath the side wall of the container.

Figure 6:
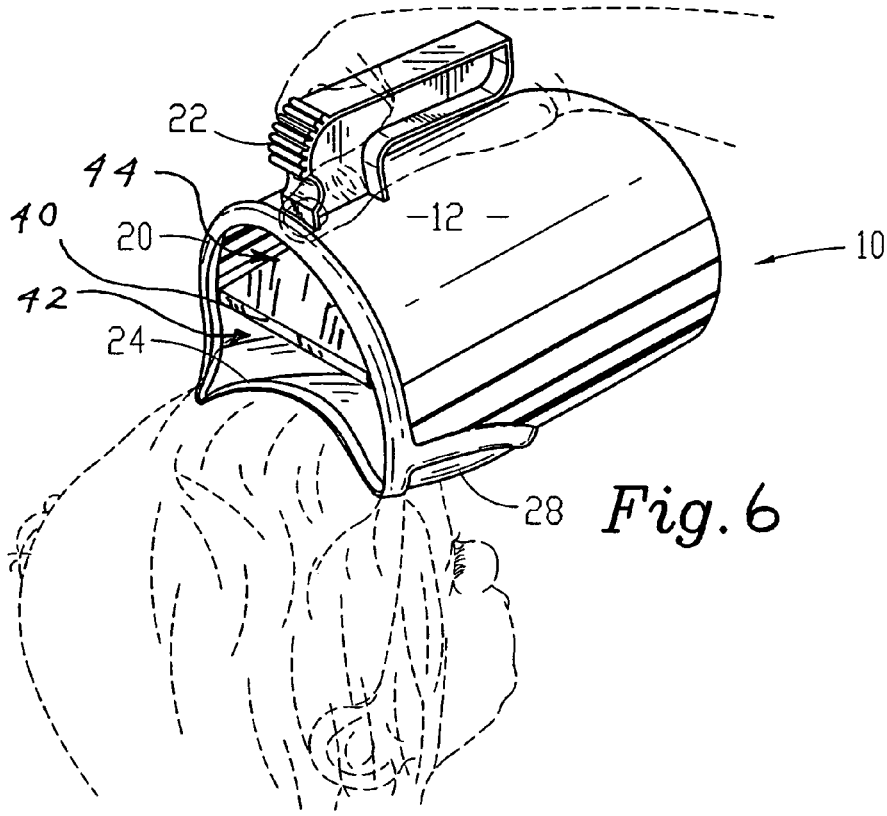
FIG. 6 shows the embodiment of FIG. 5 applied to the head of a child to allow water to flow over the child's hair and back of the head and having a divider panel within the container to provide a second source of fluid flow that is not affected by the deflection of the flexible panel.
Figure 5:
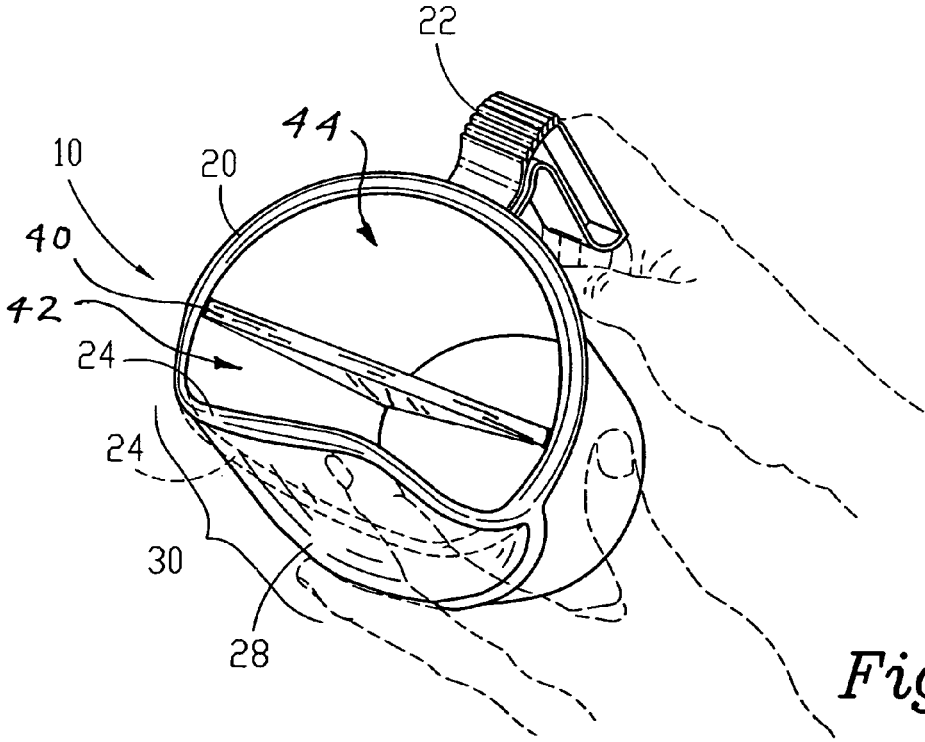
FIG. 5 shows an embodiment of the invention having a divider placed within the container to provide a second source of fluid flow.

Referring now to FIG. 5, an alternative embodiment of the present invention is shown wherein a divider panel 40 is formed or inserted within container 10 to divide the interior space defined by continuous 12 into a first compartment 42 and a second compartment 44. As has previously been described, an important aspect of the present invention is the provision of a flexible panel 28, or, alternatively, a malleable rim segment 24 which can conform to the shape of the objects against which container 10 is pressed. It will be appreciated that as flexible panel 28 is depressed inwardly to conform to the shape of the object against which container 10 is pressed that there can be a tendency for the water contained in container 10 to be diverted to one side or the other (i.e., the lower outside edges of flexible panel 28) as the middle portion of flex panel 28 is depressed inwardly, and therefore, becomes a high point which can shed water towards the outside edges as shown in FIG. 3. The alternative embodiment shown in FIGS. 5 and 6 provides a means for providing a secondary water supply which is captured within the second compartment 44. As container 10 is pressed against an object and tipped upwardly as is shown in FIG. 6, water contained in second compartment 44 will flow along divider panel 40 and will flow outwardly evenly across the width of divider panel 40 and onto the object against which container 10 is depressed. At the same time, water contained within first compartment 42 will, depending upon the degree of inward depression formed in flex panel 28 by the pressure flex panel 28 against an object, will tend to divert a greater portion of the fluid contained in first compartment 42 toward the outer, lower edges of flex panel 28 and away from the higher portion of flex panel 28 presented by the compression of flex panel 28 against an object. In this manner, the alternate embodiment of the present invention containing divider panel 40 provides increase flow of fluid across the area of the object that is causing the greater deflection of flex panel 28 by providing two separate sources of fluid. The first source of fluid being contained in first compartment 42 which flows outwardly across flex panel 28 and is susceptible to a degree of diversion depending upon the degree of flexing of flex panel 28 and a second component of fluid contained in second compartment 44 which will flow independently of the amount of depression or flexation of flex panel 28 as it flows outwardly from second compartment 44 across the surface of divider panel 40 to flow onto the object against which container 10 is compressed.

It will be appreciated by those skilled in the art that divider panel 40 may be either fixed in place within container 10, or panel 40 may be insertable and removable within container 10 through the use of a frictional fit of divider panel 40 within container 10, or by the use of support tracks formed into side wall 12 and/or bottom 18 of container 10.

As required, detailed embodiments of the present inventions are disclosed herein; however, it is to be understood that the disclosed embodiments are merely exemplary of the invention, which may be embodied in various forms. Therefore, is specific structural and functional details disclosed herein are not to be interpreted as limiting, but merely as a basis for the claims and as a representative basis for teaching one skilled in the art to variously employ the present invention in virtually any appropriately detailed structure.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the to accompanying drawings shall be interpreted as illustrative and not meant in a limiting sense.

Having now described the features, discoveries and principles of the invention, the manner in which the inventive container or pitcher is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

The invention claimed is:

1. A container comprising:

a generally rigid continuous side wall terminating in an upper side wall end and a lower side wall end and defining an inward space bounded by said continuous sidewall, a bottom closing said lower side wall end with said upper side wall end being generally open, an inwardly flexible panel forming a portion of said side wall and extending to form at least a portion of said upper side wall end, said flexible panel having a generally smooth inward surface for unobstructed fluid flow out of said open upper side wall end, and a divider spanning said interior and contacting said bottom to define first and second fluid-holding portions of said interior, said divider being oriented generally parallel to said flexible panel, said first and second fluid-holding portions operating to approximately concurrently pour a fluid onto the object pressed against said flexing panel.

2. The container as claimed in claim 1 further comprising a rim attached to said upper side wall end.

3. The container as claimed in claim 2 wherein said rim is comprised of a sponge material.

4. The container as claimed in claim 2 wherein said rim is comprised of rubber.

5. The container as claimed in claim 2 wherein said rim is comprised of cloth.

6. The container as claimed in claim 1 further comprising a handle.

7. A container comprising:

a generally rigid continuous side wall having an upper side wall end and a lower side wall end and defining an inward space bounded by said continuous sidewall, a bottom attached to said lower side wall end with said upper side wall end being generally open, a rim connected to said upper side wall end, a portion of said rim being sufficiently inwardly flexible to conform to the shape of an object to which said rim is pressed against, an inwardly flexible panel forming a portion of said side wall and connecting with said inwardly flexible rim portion, said inwardly flexible panel having a generally smooth inward surface for unobstructed fluid flow out of said open upper side wall end, and a divider spanning said interior and contacting said bottom to define first and second fluid-holding portions of said interior, said divider being oriented generally parallel to said flexible panel, said first and second fluid-holding portions operating to approximately concurrently pour a fluid onto the object pressed against said flexing panel.

8. The container as claimed in claim 7 at least a portion of said side wall is concave, said concave side wall portion having a rim portion of a flexible material.

9. The container as claimed in claim 8 wherein said rim is comprised of a sponge material.

10. The container as claimed in claim 8 wherein said rim is comprised of rubber.

11. The container as claimed in claim 8 wherein said rim is comprised of cloth.

12. The container as claimed in claim 7 further comprising a handle.

* * * * *